United States Patent [19]

Nakahama

[11] Patent Number: 4,682,961

[45] Date of Patent: Jul. 28, 1987

[54] TILT DEVICE FOR BOAT PROPULSION MACHINE

[75] Inventor: Ryoji Nakahama, Iwata, Japan

[73] Assignee: Sanshin Kogyo Kabushiki Kaisha, Hamamatsu, Japan

[21] Appl. No.: 715,165

[22] Filed: Mar. 22, 1985

[30] Foreign Application Priority Data

Mar. 26, 1984 [JP] Japan ..... 59-56268

[51] Int. Cl.[4] ..... B63H 21/26

[52] U.S. Cl. ..... 440/61; 440/63; 248/641

[58] Field of Search ..... 440/61, 62, 63; 248/641, 642

[56] References Cited

U.S. PATENT DOCUMENTS

| | | | |
|---|---|---|---|
| 1,840,948 | 1/1932 | Harvey | 440/63 |
| 3,033,500 | 5/1962 | Graves | 248/641 |
| 3,570,443 | 3/1971 | Dewhurst | 440/61 |
| 4,013,249 | 3/1977 | Meyer et al. | 440/61 |
| 4,177,747 | 12/1979 | Pichl . | |
| 4,354,848 | 10/1982 | Hall et al. | 440/61 |
| 4,363,629 | 12/1982 | Hall et al. . | |
| 4,403,969 | 9/1983 | Pichl | 440/61 |
| 4,557,696 | 12/1985 | Nakahama | 440/61 |

*Primary Examiner*—Joseph F. Peters, Jr.
*Assistant Examiner*—Thomas J. Brahan
*Attorney, Agent, or Firm*—Ernest A. Beutler

[57] ABSTRACT

Several embodiments of hydraulically operated tilt and trim units for outboard drives wherein both tilt and trim cylinders are provided that are effective to operate together to provide trim adjustment and wherein the trim cylinder is pivotally connected directly to the outboard drive. An arrangement is provided for permitting movement of the trim cylinder upon tilt up operation. In all embodiments, the piston rods of the tilt and trim cylinders are disposed so that they will be out of the water when the outboard drive is tilted up. Some embodiments employ a linkage system so that the outboard drive will move in a manner so that it will not increase significantly the effective length of the associate watercraft when the outboard drive is tilted up.

25 Claims, 9 Drawing Figures

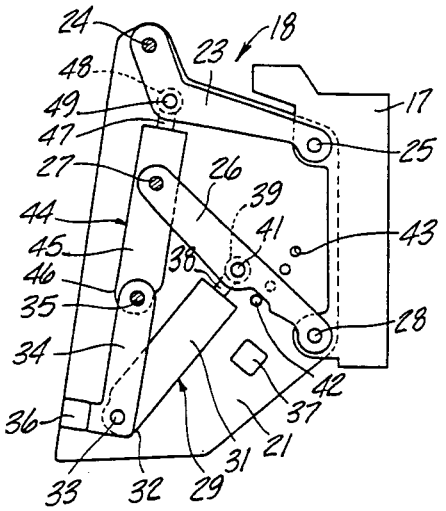
Fig-3
Fig-4
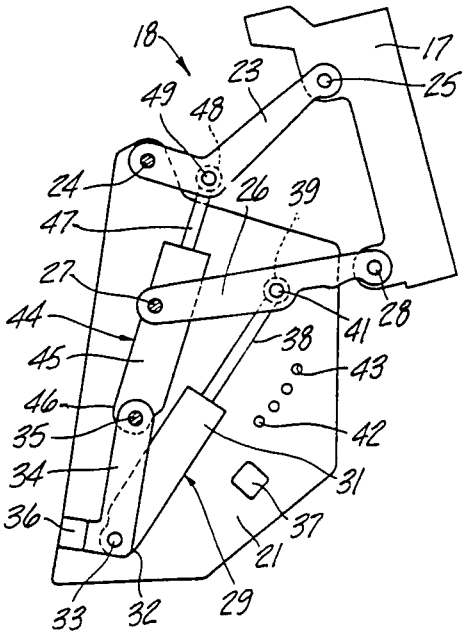
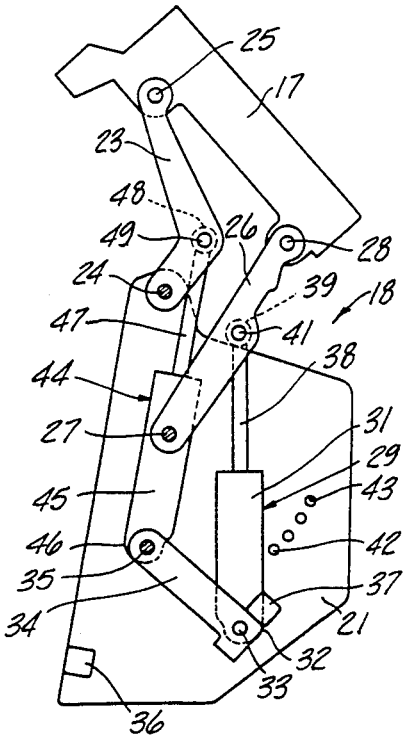
Fig-5

TILT DEVICE FOR BOAT PROPULSION MACHINE

BACKGROUND OF THE INVENTION

This invention relates to a tilt device for boat propulsion machines and more particularly to an improved tilt and trim arrangement for a marine drive.

As is well known, marine outboard drives, either the outboard drive of an inboard/outboard arrangement or an outboard motor per se, are supported for pivotal movement about a generally horizontally extending axis. This pivotal movement is provided for two purposes. First, there is a relatively narrow range of trim adjustments provided that will adjust the angle of the propulsion means relative to the watercraft so as to provide the best propulsion means relative to the watercraft so as to provide the best propulsion force for a given running condition. In addition, the tilting movement is such that the outboard drive may be tilted up so that its propulsion means is disposed out of the water during periods of nonuse.

With larger horsepower units, it has been proposed to use a hydraulic motor arrangement for achieving both the trim and tilting movement of the outboard drive. With such arrangements, a relatively more powerful but slower stroke trim fluid motor is employed for achieving the trim adjustment. Since trim adjustments are normally made during running, it is necessary for the trim adjustment motor to have sufficient power so as to offset the driving thrust of the propulsion unit. This results in the relatively low speed operation of the trim adjustment. On the other hand, when tilting the outboard drive up, the fluid motor needs only overcome the weight of the outboard drive and a relatively high speed, low power motor can be used for this purpose.

Because of the differences in stroke and strength, it has been the practice, in some applications, to employ one or more trim cylinders that are abuttingly engaged with a lower portion of the drive unit for effecting its trim adjustment. When the outboard drive is tilted up, the drive just merely moves away from the abutment with the trim cylinders. Although this simplifies the problem, it can give rise to wear and noise due to the resultant relative movement that is permitted between the outboard drive and the engaging portion of the trim cylinder. In addition, if the trim cylinders are partially extended, there is a likelihood of bending to their piston rods or other components.

In another arrangement, the trim and tilt cylinders operate in series rather than in parallel as in the aforedescribed arrangement. Although this will offset the deficiencies discussed above, it also means that only one fluid motor resists the driving thrust during trim operation and it is necessary to use a larger more powerful trim motor in such applications.

It is, therefore, a principal object of this invention to provide an improved tilt and trim arrangement for an outboard drive that will overcome the aforenoted problems.

It is a further object of this invention to provide a tilt and trim unit for a marine outboard drive wherein two fluid motors may be employed for achieving power trim adjustment without one of the fluid motors restricting the tilting movement and while still permitting a positive connection between the tilt motor and its supporting structure.

The movement of the outboard drive during its trim and tilt positioning has normally been accomplished about a single horizontally disposed axis. Although such an arrangement offers the advantages of providing a relatively simple structure, the movement of the outboard drive between its fully tilted and trimmed down position and its fully tilted and trimmed up position about such fixed horizontal axes causes the propulsion end of the unit to extend a substantial distance behind the transom of the associated watercraft. Thus, when operating in very shallow water with the outboard drive tilted up, the effective length of the watercraft increases significantly. The disadvantages of such an arrangement are discussed in the copending application entitled "Tilting Device For Outboard Engine", Ser. No. 672,410, filed Nov. 16, 1984 in my name and the names of others, which application is assigned to the assignee of this application. The construction shown in that application permits the movement of the outboard drive between a tilted down and a tilted up position without substantially increasing the effective length of the watercraft. In addition, that application shows an arrangement wherein a hydraulic device may be employed for achieving the movement between the respective positions. However, that application and the hydraulic arrangement disclosed in it presents certain of the disadvantages with the hydraulic tilt and trim arrangements aforedescribed for some of the same reasons.

It is, therefore, a still further object of this invention to provide an improved arrangement for supporting and moving an outboard drive between its tilted down trimmed down position and a tilted up trimmed up position.

It is a further object of this invention to provide an improved and simplified arrangement for permitting movement of an outboard drive without significantly increasing the effective length of the associated watercraft when the outboard drive is in its respective positions.

SUMMARY OF THE INVENTION

A first feature of this invention is adapted to be embodied in a hydraulic tilt and trim arrangement for a marine outboard drive having a housing carrying propulsion means and a base adapted to be affixed to the transom of an associated watercraft or the like for movement of the housing relative to the base from a tilted, trimmed down position through a tilted down, trimmed up position and to a tilted, trimmed up position. A trim fluid cylinder motor having an operative pivotal connection at one end to the base and an operative pivotal connection at the other end to the housing is provided for operating through a stroke of a first length for moving the housing relative to the base from a tilted, trimmed down position to a tilted down, trimmed up position. A tilt fluid cylinder motor is provided that has an operative pivotal connection at one end thereof to the base and an operative pivotal connected at the other end thereof to the housing. The trim fluid cylinder motor is operable through a first stroke portion for applying fluid pressure to the base and the housing for moving these elements relative to each other from the tilted, trimmed down position to the tilted down, trim up position. In addition, the tilt fluid cylinder motor has a total operative stroke for moving the housing from the tilted, trimmed down position to a tilted, trim up position. Means are further provided which are associated with the trim fluid cylinder motor for permitting such relative movement of the base and the housing without restriction from the trim fluid cylinder motor.

A still further feature of the invention is adapted to be embodied in a mounting and hydraulic tilt and trim arrangement for an outboard drive comprising a drive shaft housing and a lower unit supporting and driving a propeller shaft carrying a propeller. Linkage means are adapted to be affixed to an associated watercraft and means connect the linkage means to the outboard drive for movement of the outboard drive relative to the associated watercraft from a tilted down, driving position through a plurality of trim positions to a tilted up out of the water position. The linkage means is effective to cause the propeller shaft to be raised upon movement from the drive position to the out of the water position and rotated through an angle less than the angle necessary to raise the propeller shaft the same height if the outboard drive were pivoted relative to the watercraft about a fixed pivot axis. A first, trim hydraulic fluid motor is provided for moving the outboard drive through its plurality of trim positions. The first trim fluid motor has an operative pivotal connection to a first portion of the linkage means at a first location. A tilt fluid motor is also provided for moving the outboard drive through its plurality of trim positions and further to its tilted up out of the water position. The tilt fluid motor has an operative pivotal connection to the linkage means spaced from the connection of the trim fluid motor to the linkage means.

BRIEF DESCRIPTION OF THE DRAWINGS

FIGS. 3, 4 and 5 are enlarged, side elevational showing the linkage for supporting the outboard drive and the tilting and trim hydraulic motors associated therewith of the first embodiment.

FIG. 3 shows the arrangement in the tilted, trimmed down position.

FIG. 4 shows the arrangement in the tilted down, trim up position.

FIG. 5 shows the arrangement in the tilted, trim up position.

FIG. 6 shows the tilted, trimmed down position.

FIG. 7 shows the tilted down, trim up position.

FIG. 8 shows the tilted, trim up position.

DETAILED DESCRIPTION OF THE PREFERRED EMBODIMENTS

EMBODIMENT OF FIGS. 1 THROUGH 5

Figure 1:
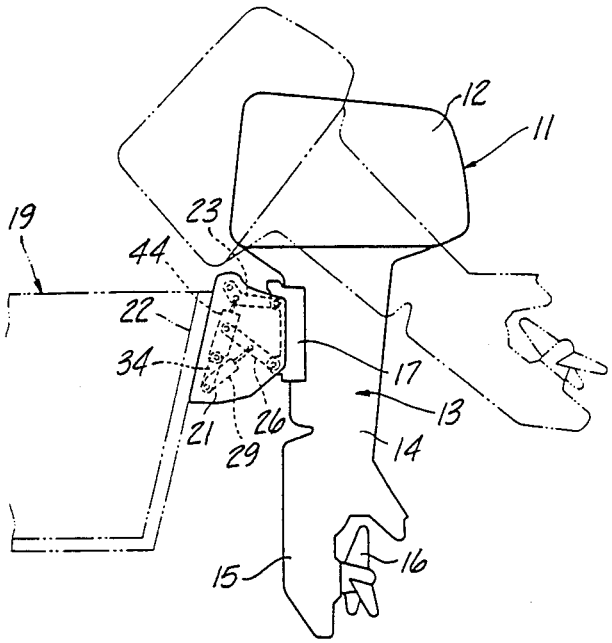
FIG. 1 is a side elevational view of an outboard drive constructed in accordance with a first embodiment of the invention as attached to an associated watercraft, shown in phantom, and illustrating the outboard drive in solid lines in its tilted, trimmed down position and in phantom lines in its tilted, trim up position.

An outboard drive constructed in accordance with a first embodiment of the invention is shown in FIGS. 1 through 5. The term "outboard drive" as used herein is intended to cover either the outboard drive portion of an inboard/outboard assembly or an outboard motor per se. In accordance with the embodiments of the invention specifically illustrated and described, an outboard motor is specifically the form of outboard drive with which the invention is embodied. It should be understood, however, that certain facets of the invention can be used in conjunction with the outboard drive portion of an inboard/outboard drive assemblage.

An outboard motor is indicated generally by the reference numeral 11 and includes a power head 12 in which an internal combustion engine of any known type may be positioned for providing the motive force for the outboard motor 11. The internal combustion engine drives a drive shaft that extends through a housing assembly, indicated generally by the reference numeral 13, and which includes a drive shaft housing 14. A lower unit 15 depends from the drive shaft housing 14 and contains a suitable forward, neutral, reverse transmission for driving an appropriate propulsion device, such as a propeller 16 and its shaft. The drive shaft housing 14 is connected by means of a steering shaft (not shown) to a swivel housing 17 for supporting the housing assembly 13 for steering movement about a generally vertically extending axis in a known manner.

A linkage assembly, indicated generally by the reference numeral 18 and shown in most detail in FIGS. 3 through 5, is provided for supporting the outboard motor 11 for tilting and trim movement relative to the associated watercraft, shown in phantom and identified generally by the reference numeral 19. The linkage assembly 18 includes a base comprised of a bracket assembly 21 that is adapted to be clamped in a suitable manner to a transom 22 of the watercraft 19.

The linkage assembly 18 includes a first link 23 that has a generally L shape and which is pivotally connected at one end, by means of a pivot pin 24, to the bracket assembly 21. The opposite end of the link 23 is pivotally connected to an upper portion of the swivel bracket 17 by means of a pivot pin 25. A second, generally straight, link 26 is pivotally connected at its forward end to the bracket 21 by means of a pivot pin 27. The opposite end of the link 26 is pivotally connected to the swivel bracket 17, by means of a pivot pin 28, at a point below the pivot pin 25.

The geometry of the linkage system 18 is chosen so that when the outboard motor 11 is swung through its trim range of positions, in the manner to be described, that the axis of rotation of the propeller 16 will be at the optimum angle to the associated watercraft 19 and at the appropriate height, in the manner as described in the aforenoted copending application Ser. No. 672,410. Also, the linkage arrangement 18 is such that when the outboard motor 11 is tilted to its fully tilted up position that the end of the lower unit 16 will not project as far to the rear of the transom 22 as if the outboard motor 11 were pivotal about a single horizontal axis, as with many types of prior art constructions. Again, reference may be had to copending application Ser. No. 672,410 for a description of the functioning and advantages of the linkage system 18.

The trim movement of the outboard motor 11 is achieved hydraulically by means of a hydraulic cylinder and piston type fluid motor, indicated generally by the reference numeral 29. The fluid 29 has a cylinder assembly 31 that is formed with a trunion 32 at its lower end that accommodates a pivot pin 33 for pivotal connection to the lower end of a link 34. The upper end of the link 34 is pivotally connected to the bracket 21 by means of a pivot pin 35. The link 34 is pivotal between a lower position, as shown in FIGS. 3 and 4, wherein it engages a first stop 36 carried by the bracket 21 and an upper position, as shown in FIG. 5, wherein it engages a second stop 37 carried by the bracket 21. This pivotal movement and the manner in which it is accomplished and its function will be described later.

A piston, later to be described, is positioned within the cylinder assembly 31 and is connected to a piston rod 38 for effecting reciprocation of the piston rod 38 upon operation of the fluid motor 29. The piston rod 38 is formed with an eyelet 29 at its outer end that is pivoted to the link 26, intermediate its ends, by means of a pivot pin 41.

The normal trim position for the outboard motor 11 is determined by a trim pin 42 that is abuttingly engaged with the lever 26 and which is received in selective trim pin openings 43 formed in the bracket 21.

The trim movement of the outboard motor 11 is assisted and the tilting of it is accomplished by a tilt hydraulic cylinder and piston motor assembly, indicated generally by reference numeral 44. The tilt motor assembly 44 includes a cylinder assembly 45 that has a trunion 46 at its lower end for pivotal connection to the bracket 21 by means of the pivot pin 35. A hydraulically actuated piston, to be described, is contained within the cylinder assembly 45 and is connected to a piston rod 47 for effecting its reciprocation. The piston rod 47 is formed with an eyelet 48 at its outer end that affords a pivotal connection to the bight of the lever 23 by means of a pivot pin 49.

The hydraulical circuitry for operating the tilt cylinder 44 and the trim cylinder 29 will now be described by particular reference to FIG. 2. This system includes a reversible positive displacement fluid pump 51 that is driven in opposite directions selectively by a reversible electric motor 52. The pump 51 has a pair of ports 53 and 54 either of which can function as a pressure port with the other functioning as the suction port depending upon the direction of rotation of the motor 52 and pump 51. Makeup lines 55 and 56 communicate with a fluid reservoir 57 by means of check valves 58 and 59, respectively, so as to provide for makeup fluid, if required.

The ports 53 and 54 are connected by lines to a shuttle valve assembly 61 in which a shuttle piston 62 is proivded. The shuttle piston 62 divides the internal chamber of the shuttle valve assembly 61 into a first chamber portion 63 that communicates with the port 53 and a second chamber portion 64 that communicates with the port 54. A check valve 65 is provided for controlling the flow from the chamber portion 63 to a further chamber portion 66. In a like manner, a check valve 67 controls the communication between the chamber portion 64 and a yet further chamber portion 68. A first conduit 69 extends from the chamber portion 66 to the cylinder assembly 44 and specifically to a lower chamber 71 formed therein beneath a floating piston 72. The floating piston 72 cooperates with a main piston 73 that is affixed to the piston rod 47. A conduit 74 communicates the shuttle valve chamber portion 68 with a second chamber 75 formed in the tilt cylinder assembly 44 above the piston 73.

The piston assembly 73 is provided with a pressure responsive absorber valve assembly 76 that will permit flow from the chamber 75 to the portion of the chamber 71 above the floating piston 72 so as to permit the motor 11 to pop up and avoid damage. When the underwater obstacle is cleared, the motor 11 may lower and fluid will be returned to the chamber 75 from the chamber 71 through a relief valve 77 provided in the piston 73. The absorber valve 76 requires a substantailly higher pressure to open than does the relief valve 77. Preferably, the relief valve 77 opens at the pressure determined by the weight of the motor 11 so as to permit its return to the trim adjusted position once the underwater obstacle has been cleared, as aforenoted.

A further fluid line 78 extends from the line 69 to the trim cylinder assembly 29 and specifically to a chamber 79 formed below a floating piston 81 within the cylinder assembly 31. The floating piston 81 cooperates with a main piston 82 that is affixed to the piston rod 39. A passage 83 extends through the piston 82 so as to provide communication between the portion of the chamber 79 above the floating piston 81 and a chamber 84 formed above the piston 82. A fluid line 85 interconnects the chamber 84 with the oil reservoir 57.

The hydraulic circuit further includes a trim down relief line 86 that communicates the pump port 54 with the reservoir 57 for providing relief under the trim down condition in the event the motor 52 and pump 51 are not stopped when the pistons 73 and 82 reach the bottom extremities of their strokes.

In addition, a manually operated valve 87 is interposed between the lines 69 and 74 and communicates with the sump 57 so as to provide for manual tilting up of the outboard motor 11 without significant fluid resistance.

The operation of the device will now be described. FIG. 3 shows the condition of the linkage 18 when the outboard motor 11 is in its normal tilted, trimmed down running condition. As has been previously noted, this location is determined by the positioning of the trim pin 42 within the bracket trim openings 43. At this condition, both the trim cylinder assembly 28 and tilt cylinder assembly 44 are at the one extreme positions of their strokes with the respective main pistons 82 and 73 and floating pistons 81 and 72 at the generally bottom portion of the cylinders 31 and 45, respectively.

If it is desired to effect trim up of the outboard motor 11, and this is normally done under running conditions, the motor 52 is energized so as to drive the pump 51 in a direction to pressurize the port 53 and cause the port 54 to act as a suction port.

Pressurization of the port 53 causes the shuttle piston 62 to move to the right and one of its two projections engages the ball of the check valve 67 and unseats it to open communication between the chamber portions 64 and 68. Pressurization of the chamber portion 63 generates sufficient pressure to unseat the ball check valve 65 and permit flow to occur from the chamber portion 63 into the chamber portion 67 and lines 69 and 78. Pressurization of the line 78 causes fluid to be delivered to the trim cylinder chamber 79 so as to urge the floating piston 81 and main piston 82 upwardly to extend the piston rod 39 and effect a pivotal force on the link 26. At the same time, the pressurization of the line 69 causes fluid to be delivered to the tilt cylinder chamber 71 so as to urge its floating piston 72 and main piston 73 upwardly so that the piston rod 47 exerts a force on the link 23 so as to effect its pivotal movement about the pivot pin 24. Thus, the fluid motors 29 and 44 act in parallel so as to sum their forces on the motor 11 to effect its tilting up.

When the trim cylinder piston 73 moves upwardly, fluid is displaced from its chamber 75 through the line 74 into the shuttle valve chamber portion 68. Since the ball check valve 67 is unseated, this fluid may flow into the chamber portion 64 and back to the pump port 54 so as to provide the fluid to its suction side. Fluid displaced from the chamber 84 of the trim cylinder assembly 29 is expelled back to the sump 57 through the line 85.

It should be noted that during this initial tilting movement of the outboard motor 11, the link 34 will be held in engagement with the stop 36 by both the pressure of the tilt cylinder 29 and the weight and driving thrust of the outboard motor 11. Since the tilt cylinder 29 and trim cylinder 44 act together, as aforenoted, they will generate sufficient pressure so as to achieve the trim adjustment even through high driving forces may be encountered. Because the two cylinders operate in parallel, it is possible to use smaller cylinders than were they not operative together. Also, as has been noted, the linkage system 18 is such that the proper angle for the propellers 16 relative to the hull 19 will be afforded at each respective trim position.

The trim adjustment may continue through the full range of the stroke of the trim cylinder 29 so as to effect maximum trim up as shown in the position in FIG. 4. In this regard, the trim cylinder 29 has a substantially lesser effective stroke than the tilt cylinder 44 so that the trim cylinder piston 82 will reach its upper limit well before the tilt cylinder piston 73 has reached its upper limit.

If the motor 52 and pump 51 are continued to be driven in the direction so as to pressurize the port 53, the motor 11 may be tilted up in the manner now to be described. If the line 69 is still pressurized after the trim cylinder 29 has reached the end of its stroke, fluid will still be supplied to the line 69 and the floating piston 72 and main piston 73 will be urged upwardly. During this movement and since the trim cylinder 29 is at the end of its stroke, the link 26 will continue to rotate as the link 23 is rotated and a lifting force will be exerted on the trim cylinder 29 through the pin 41 and piston rod 38. Movement is permitted since the link 34 that supports the lower end of the cylinder assembly 31 may pivot through an arc around the pivot pin 35 until the link 34 is moved into abutment with the stop 37 (FIG. 5). At this time, the motor 11 will be in its tilted, trim up condition as shown in the phantom line view in FIG. 1 and further elevation is not possible. At this time the trim cylinder 44 will have effectively reached the end of its stroke. It should be noted that in this condition, the piston rods 47 and 38 are disposed substantially above the water line so that they will not be fouled even if the motor 11 is left tilted up for long periods of time.

Tilting down operation from the position shown in FIG. 5 is achieved by operating the motor 52 so as to drive the pump 51 in a direction that the port 54 is pressurized and the port 53 acts as a suction port. Pressurization of the port 54 causes fluid pressure in the shuttle valve chamber portion 64 to cause the shuttle piston 62 to move to the left so that its other projection will engage the ball check valve 65 and unseat it so as to open communication between the chamber portions 63 and 66. Thus, both the lines 69 and 78 will be opened to the suction port 53 of the pump 51.

Pressurization of the chamber 64 causes sufficient pressure to be generated so as to unseat the ball check valve 67 and open communication with the chamber portion 68. This pressurizes the line 74 and causes fluid to flow into the tilt cylinder chamber 75 to urge the main piston 73 and floating piston 72 downwardly. Fluid is expelled from the chamber 71 back to the suction port 53 through the line 69, chamber portion 66 and chamber portion 63 past the opened check valve 65. It should be noted that during this movement the trim cylinder 29 is not contracted since there is no significant force acting on the piston rod 39 to urge it downwardly. During the initial downward movement caused by pivoting of the links 23 and 26, the link 34 will again pivot back to the position shown in FIG. 4, if the pump 51 is energized for a sufficient period of time.

When the link 34 has rotated sufficient so as to engage the stop 36 and, assuming the pump 51 is continued to be operated, the pressure of the tilt cylinder 44 and the weight of the motor 11 will be sufficient so as to drive the piston rod 39 and piston 83 downwardly. Fluid is then displaced from the chamber 79 under the floating piston 81 back through the line 78 to the suction side of the pump 51 through the aforedescribed conduits. When the piston 82 moves downwardly, the chamber 84 will be replenished with fluid from the sump 57 through the line 85. This movement can be continued by the operator until the desired trim down condition is reached.

As has been previously noted, the device also permits the motor 11 to pop up in the event of forward travel and the striking of an underwater obstacle. When this happens, there will be sufficient force generated on the piston rod 47 so as to overcome the pressure required to open the absorber valve 76 and fluid may flow from the chamber 75 to the area in the chamber 71 above the floating piston 72. During this movement, the trim cylinder assembly 29 will not undergo any expansion and the link 34 will merely rotate with the piston rod 38 and cylinder assembly 31 following the pivotal movement of the link 26 unless the link 34 contacts the stop 37. If this occurs, there will be some extension of the piston rod 39 and fluid will flow from the chamber 84 through the opening 83 to the area in the chamber 79 above the floating piston 81. Thus, in this stage, both tilt cylinder 44 and trim cylinder 29 will tend to resist the popping up action.

During the aforenoted movement, it should be noted that the floating pistons 72 and 81 will undergo substantially no movement and hence their positions will remain substantially fixed so as to form a memory for the return movement of the outboard motor 11.

When the obstacle is cleared, the relief valve 77 will open so as to permit reverse flow from the portion of the chamber 71 above the floating piston 72 back to the chamber 75. If the piston 82 has been extended, there will be a like flow from the area in the chamber 79 above the floating piston 81 back to the chamber 84 through the opening 82. Because the two cylinders act together to absorb the loads, the linkage system need not be as strong as with prior art arrangements where this is not done. Also, since the trim piston rod 39 is coupled to the linkage system 18, there will be no wear as with prior art arrangements where the trim cylinder piston rods were in abutting engagement with the outboard drive. Furthermore, the likelihood of bending of the trim cylinder piston rod is avoided.

EMBODIMENT OF FIGS. 6 THROUGH 8

Figure 6:
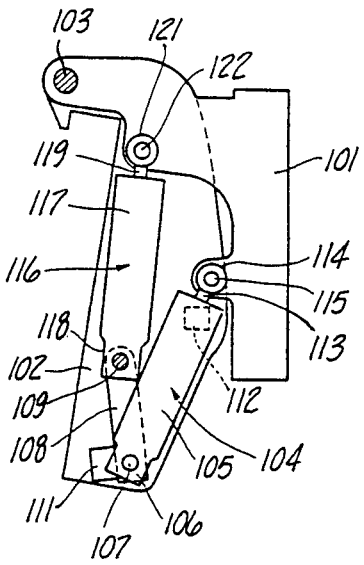
FIGS. 6, 7 and 8 are views corresponding to FIGS. 3, 4 and 5, showing another embodiment of the invention.
Figure 7:
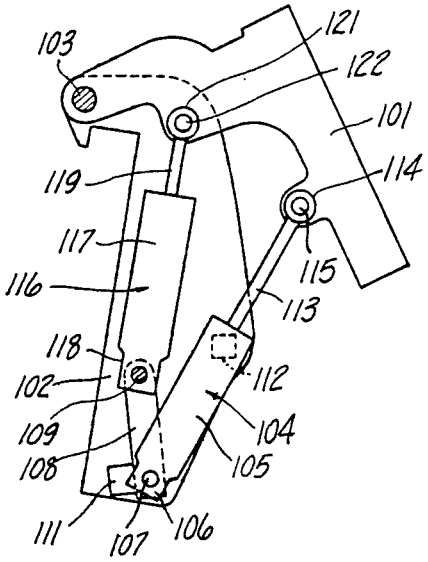
Figure 8:
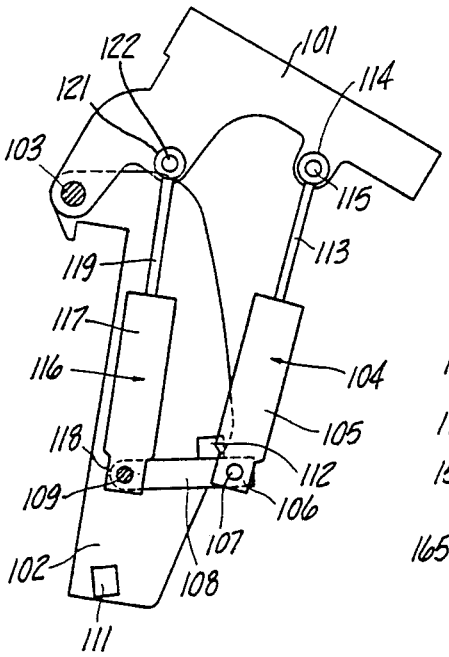

The preceding embodiment employs a linkage system of the type generally shown in copending application Ser. No. 672,410, previously mentioned. It is to be understood, however, that the cylinder assembly employed and certain of its advantages may be utilized in conjunction with more conventional outboard motor mounting arrangements and such an arrangement is shown in FIGS. 6 through 8. Since the construction of the watercraft and outboard motor per se are the same as the previously described embodiment and since the hydraulic circuitry is the same, these components have not been illustrated nor will they be described in any detail.

In this embodiment, a swivel bracket assembly 101 supports the outboard motor (not shown) for its steering movement in a normal manner. The swivel bracket assembly 101 is, in turn, pivotally supported by means of a base such as a clamping bracket assembly 102, that is adapted to be affixed to the hull of the associated watercraft in a known manner, by a pivot pin 103. Thus, the swivel bracket 101 pivots relative to the clamping bracket assembly 102 about a fixed pivot axis defined by the pivot pin 103.

A trim cylinder assembly 104 is provided with a cylinder housing 105 that has a trunion portion 106. The trunion portion 106 accommodates a pivot pin 107 so as to pivotally connect the cylinder assembly 105 to the lowr end of a link 108. The link 108 is pivotally supported on the clamping bracket 102 by means of a pivot pin 109. The link 108 is pivotal between a first position where it engages a stop 111 carried by the clamping bracket 102 and a second position wherein it engages a further stop 112 carried by the clamping bracket 102.

The trim cylinder assembly 104 further includes a floating and main piston (not shown) as in the previously described embodiment. The main piston is connected to a piston rod 113 that has an eyelet 114 at its outer end. The eyelet 114 accommodates a pivot pin 115 for pivotally connecting the piston rod 113 to a lower portion of the swivel bracket 101.

A tilt cylinder assembly, indicated generally by the reference numeral 116, is also provided. The tilt cylinder assembly 116 has a cylinder housing 117 that is formed with a trunion 118 at its lowre end. The pivot pin 109 pivotally connects the trunion 118 of the cylinder assembly 116 to the clamping bracket 102.

As with the embodiment of FIGS. 1 through 5, the cylinder assembly 117 contains a floating piston and a valved main piston (not shown). The main piston is connected to a piston rod 119 that carries an eyelet 121 at its outer end. The eyelet 121 accommodates a pivot pin 122 for pivotally connecting the piston rod 119 to the swivel bracket 103 at a point upwardly and forwardly of the pivot pin 115.

Figure 2:
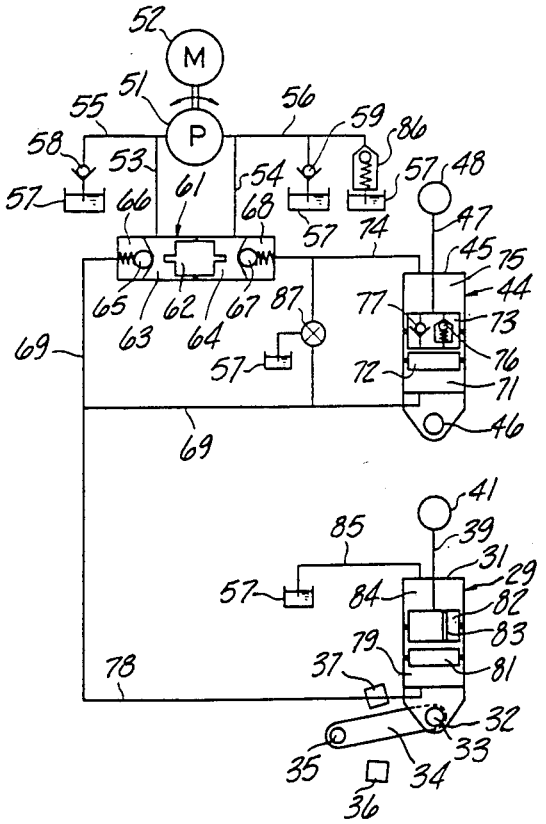
FIG. 2 is a schematic view of the hydraulic system for operating the outboard drive in accordance with the embodiments of the invention.

As has been noted, the fluid circuitry for the embodiment of FIGS. 6 through 8 is the same as the previously described embodiment and as is illustrated in FIG. 2. FIG. 6 shows the outboard motor in its tilted, trimmed down condition. In this condition, both the trim cylinder 104 and the tilt cylinder 116 are at the extreme inward ends of their strokes. If it is desired to achieve trim adjustment, the cylinders 104 and 116 are both energized as aforedescribed. This causes their respective piston rods 113 and 119 to extend so that they both apply a force on the swivel bracket 101 to effect pivotal movement about the pivot pin 113. Thus, as with the previously described embodiment, both cylinder assemblies 104 and 116 apply their force to the outboard motor so as to afford trim adjustment. As a result, there will be sufficient force so as to overcome the driving thrust of the outboard motor.

This movement will continue, as long as the pump is energized, until the trim cylinder assembly 104 reaches the end of its stroke and the piston rod 113 is fully extended. If the pump is continued to be operated after the trim cylinder 114 reaches the end of its stroke, the tilt cylinder 116 will cause further extension of its piston rod 119 since, as in the previously described embodiment, the tilt cylinder 116 has a longer effective stroke than the trim cylinder 104.

When the piston rod 119 continues to extend and the swivel bracket 101 is pivoted beyond the position shown in FIG. 7, a force will be exerted from the swivel bracket 101 on the piston rod 113 and will lift the piston rod 113 and trim cylinder 104 to effect pivotal movement of the link 108 (FIG. 8). This movement will continue until the piston rod 119 reaches the end of its stroke and the link 108 reaches and engages the stop 112.

Downward movement occurs in a manner that is believed to be obvious in light of the discussion of the previous embodiment. Like the previous embodiment, this embodiment can incorporate shock absorbing for pop up of the outboard motor when an underwater obstacle is struck. Thus, this embodiment retains the advantages of the embodiment of FIGS. 1 through 5 in that the piston rods 119 and 113 when fully extended are well clear of the water and the cylinders 104 and 106 act together to afford trim adjustment. Furthermore, a two stage shock absorbing on pop up will be achieved in the same manner as the previously described embodiment. However, this embodiment does not have the advantages of the embodiment of FIGS. 1 through 5 afforded by its unique linkage system.

EMBODIMENT OF FIG. 9

Figure 9:
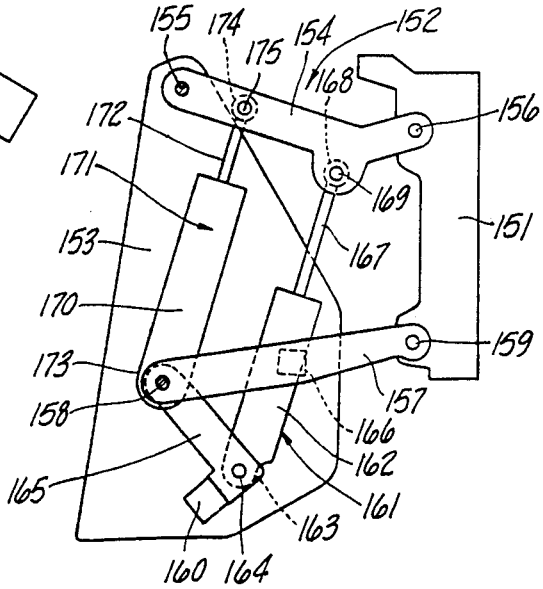
FIG. 9 is a side elevational view, in part similar to FIGS. 3 and 6, showing a still further embodiment of the invention.

A further embodiment of the invention is shown in FIG. 9. This embodiment is similar to the embodiment of FIGS. 1 through 5 in the use of a linkage system for supporting the outboard drive, however, the tilt and trim cylinders are connected to the linkage system in a slightly different manner. Because the hydraulic system and construction of the outboard motor and attachment to the associated watercraft are the same as the embodiment of FIGS. 1 through 5, these components have not been illustrated nor will they be described again.

In this embodiment, a swivel bracket 151 is provided to afford a steering connection to the outboard motor (not shown). The swivel bracket 151 is supported by means of a linkage system, indicated generally by the reference numeral 152, from a base comprised of a bracket assembly 153. The bracket assembly 153 is adapted to be attached to the transom of the associated watercraft in a known manner.

The linkage system 152 includes a first link 154 that is pivotally connected at one end to the clamping bracket 153 by means of a pivot pin 155. The opposite end of the first link 154 is connected to the upper portion of the swivel bracket 151 by a pivot pin 156.

A second link 157 is pivotally connected at one end to the bracket 153 by means of a pivot pin 158. The opposite end of the link 157 is connected to the swivel bracket 151 by means of a further pivot pin 159. The linkage system 152 is oriented in a manner similar to that of the embodiment of FIGS. 1 through 5 and that described in the aforenoted copending application Ser. No. 672,410 and, for that reason, the advantages and operation of this linkage system will not be described again in detail. Suffice it to say that the linkage system 152 is oriented so as to provide the proper angle of the propeller relative to the hull of the associated watercraft at all trim adjusted positions and also permits tilt up of the outboard motor without significantly increasing the effective length of the watercraft.

As with the previously described embodiments, a trim cylinder assembly 161 is provided that has a cylinder housing 162. The cylinder housing 162 is formed with a trunion 163 that accommodates a pivot pin 164 so as to pivotally connect the housing 162 to one end of a lever 165. The oppsoite end of the lever 165 is connected by the pivot pin 158 to the bracket 153. The lever 165 is pivotal between a position shown in FIG. 9, wherein it engages a first stop 160 and an extended position where it engages a second stop 166. The stops 160 and 166 are carried by the bracket 153.

The trim cylinder 161 has a flowing and main piston as with the previously described embodiments. The main piston is connected to a piston rod 167 which has an eyelet 168 at its outer end. A pivot pin 169 extends through the eyelet 168 and pivotally connects the piston rod 167 to the link 154 at a point adjacent but spaced inwardly from the pivot pin 156. Hence, extension of the piston rod 167 causes a force to be exerted on the link 154 to effect its pivotal movement about the pivot pin 155.

A tilt cylinder assembly, indicated generally by the reference numeral 171 is also provided. The tilt cylinder assembly 171 has a cylinder housing 170 that is formed with a trunion 173 for pivotal connection to the bracket 153 by the pivot pin 158.

As with the previously described embodiments, the tilt cylinder assembly 153 includes a floating piston and a main piston. The main piston is connected to a piston rod 172 that has an eyelet 174 at its outer end. A pivot pin 175 connects the eyelet 174 and piston rod 172 to the link 154 between the pivot pins 169 and 155. Hence, an extension of the piston rod 172 causes a force to be exerted on the link 154 that effects its pivotal movement about the pivot pin 155.

This embodiment operates substantially the same as the embodiment of FIGS. 1 through 5. That is, during initial actuation of the trim cylinder 161 and tilt cylinder 171, both piston rods 167 and 172 will act in unison and effect trim adjustment of the outboard motor. When the trim adjusting cylinder 161 reaches the end of its stroke, which is shorter than the stroke of the tilt cylinder 171, it will not extend further and further extension of the tilt cylindar 171 will cause the trim cylinder 161 to follow the link 154 as permitted by pivotal movement of the link 156. This movment will continue until the piston rod 172 reaches the end of its stroke and the link 156 engages the stop 166. Reverse movement is achieved in the opposite manner, which is believed to be apparent from the previous descriptions. In addition, the shock absorbing operation of this device and its other advantages are the same as those of FIGS. 1 through 5 and these will not be repeated.

From the foregoing, it should be readily apparent that an improved arrangement has been disclosed wherein both tilt and trim cylinders act in unison to achieve trim adjustment of an outboard drive. As a result, faster and more powerful trim adjustments may be made. Furthermore, in all embodiments, the piston rods of the two cylinders will be disposed clear of the water when the outboard drive is tilted up so as to avoid corrosion or the like. Because the tilt cylinder has a pivotal rather than an abutting condition with the outboard drive, noise will be reduced, wear will be reduced and the likelihood of bending of its piston rod will be avoided. In addition, the linkage system may be generally lighter than with prior art constructions because of the use of both cylinders to absorb shocks and the progressive operation of the device. Also, the embodiment of FIGS. 1 through 5 and of FIG. 9 afford the advantages of the linkage system as described in application Ser. No. 672,410 previously referred to.

Although several embodiments of the invention have been illustrated and described, various changes and modifications may be made without departing from the spirit and scope of the invention, as defined by the appended claims.

I claim:

1. A hydraulic tilt and trim arrangement for a marine outboard drive having a housing carrying propulsion means and a base adapted to be affixed to the transom of an associated watercraft or the like, means supporting said housing from said base for movement of said housing relative to said base from a tilted, trimmed down position through a tilted down, trim up position and to a tilted, trimmed up position, a trim fluid motor having an operative pivotal connection at one end to said base and an operative pivotal connection at its other end to said housing, said trim fluid motor being operable through a stroke of a first length for moving said housing relative to said base from said tilted, trim down position to any of a plurality of tilted down, trim up trim positions, a tilt fluid motor having an operative pivotal connection at one end thereof to said base and an operative pivotal connection at the other end thereof to said housing, said tilt fluid motor being operable through a first stroke portion for applying fluid pressure to said base and said housing for effecting trim pivotal movement of said housing relative to said base, means for pressurizing said trim fluid motor and said tilt cylinder motor for actuating said trim fluid motor and said tilt fluid motor so that said trim fluid motor and said tilt fluid motor act in parallel relation to effect movement of said housing relative to said base through the full range of trim positions, said tilt fluid motor having a total operative stroker greater than said first stroke portion for effecting movement of said housing relative to said base from said tilted down, trimmed up position to said tilted, trimmed up position upon continued movement thereof, and means associated with said trim fluid motor for permitting movement of said housing and said base relative to each other for movement of said housing to said tilted, trimmed up position without restriction from said trim fluid motor.

2. A hydraulic tilt and trim arrangement as set forth in claim 1 wherein the fluid motors are linear motors comprised of a cylinder housing, a piston and a piston rod affixed to said piston and extending from said cylinder housing, the pivotal connections being to one end of the cylinder housing and to the exposed end of the piston rod.

3. A hydraulic tilt and trim arrangement as set forth in claim 1 wherein the means for permitting the relative movement of the housing and the base without restriction from the trim fluid motor comprises means for mounting said trim cylinder motor for movement as a unit relative to one of the housing and the base.

4. A hydraulic tilt and trim arrangement as set forth in claim 3 wherein the means for mounting the trim fluid motor for movement comprises means for permitting one of the operative pivotal connections to move.

5. A hydraulic tilt and trim arrangement as set forth in claim 4 wherein the means for permitting one of the operative pivotal connections to move comprises a pivotally supported link pivotally connected at one end to the fluid motor.

6. A hydraulic tilt and trim arrangement as set forth in claim 1 further including shock absorbing means carried by the tilt fluid motor for resisting forces tending to cause the housing to pop up upon striking an underwater obstacle at a restricted rate.

7. A hydraulic tilt and trim arrangement as set forth in claim 6 further including means associated with the tilt fluid motor for providing fluid resistance to popping up of the housing upon the striking of an underwater obstacle.

8. A hydraulic tilt and trim arrangement as set forth in claim 1 wherein the means for supporting the housing for movement relative to the base comprises a first link pivotally connected at one end to said base and pivotally connected at its other end to said housing and a second link pivotally connected at one end to said base and pivotally connected at its other end to said housing.

9. A hydraulic tilt and trim arrangement as set forth in claim 8 wherein the links are not parallel to each other.

10. A hydraulic tilt and trim arrangement as set forth in claim 9 wherein the fluid motors are linear motors comprised of a housing, a piston and a piston rod affixed to said piston and extending from said cylinder housing, the pivotal connections being to one end of the cylinder housing and to the exposed end of the piston rod.

11. A hydraulic tilt and trim arrangement as set forth in claim 9 wherein the means for permitting the relative movement of the housing and the base without restriction from the trim fluid motor comprises means for mounting said trim fluid motor for movement as a unit relative to one of the housing and the base.

12. A hydraulic tilt and trim arrangement as set forth in claim 11 where the means for mounting the trim fluid motor for movement comprises means for permitting one of the operative pivotal connections to move.

13. A hydraulic tilt and trim arrangement as set forth in claim 12 wherein the means for permitting one of the operative pivotal connections to move comprises a pivotally supported link pivotally connected at one end to the trim fluid motor.

14. A hydraulic tilt and trim arrangement as set forth in claim 13 wherein the operative pivotal connection between the other ends of the trim fluid motor and the tilt fluid motor are direct pivotal connections to one of the links.

15. A hydraulic tilt and trim arrangement as set forth in claim 14 wherein the direct pivot connection of the other end of the trim fluid motor is to one of the first and second links and the direct pivotal connection of the other end of the tilt fluid motor is to the other of the first and second links.

16. A hydraulic tilt and trim arrangement as set forth in claim 14 wherein the direct pivotal connections of the other ends of the fluid motors are to a common link.

17. A tilt and trim mounting arrangement as set forth in claim 8 wherein the propulsion means comprises a propeller shaft wherein the links are effective to cause said propeller shaft to be raised upon movement from the drive position to the out of water position and rotated through an angle less than the angle necessary to raise said propeller shaft the same height if said outboard drive were pivoted relative to the watercraft about a fixed pivot axis.

18. A tilt and trim mounting arrangement as set forth in claim 17 wherein the links are non-parallel.

19. A tilt and trim mounting arrangement as set forth in claim 17 wherein the links are of unequal length.

20. A tilt and trim mounting arrangement as set forth in claim 19 wherein the links are non-parallel.

21. A hydraulic tilt and trim arrangement as set forth in claim 1 wherein the housing is pivotally supported by the base for its movement.

22. A hydraulic tilt and trim arrangement as set forth in claim 21 wherein the fluid motors are linear motors comprised of a cylinder housing, a piston and a piston rod affixed to said piston and extending from said cylinder housing, the pivotal connections being to one end of the cylinder housing and to the exposed end of the piston rod.

23. A hydraulic tilt and trim arrangement as set forth in claim 21 wherein the means for permitting the relative movement of the housing and the base without restriction from the trim fluid motor comprises means for mounting said trim fluid motor for movement as a unit relative to one of the housing and the base.

24. A hydraulic tilt and trim arrangement as set forth in claim 23 wherein the means for mounting the trim fluid motor for movement comprises means for permitting one of the operative pivotal connections to move.

25. A hydraulic tilt and trim arrangement as set forth in claim 24 wherein the means for permitting one of the operative pivotal connections to move comprises a pivotally supported link pivotally connected at one end to the trim fluid motor.

* * * * *